US009126730B1

(12) United States Patent
Lobdell

(10) Patent No.: US 9,126,730 B1
(45) Date of Patent: Sep. 8, 2015

(54) RECYCLABLE STORAGE LID AND CONTAINER

(71) Applicant: Roy Jesse Lobdell, Freeville, NY (US)

(72) Inventor: Roy Jesse Lobdell, Freeville, NY (US)

( * ) Notice: Subject to any disclaimer, the term of this patent is extended or adjusted under 35 U.S.C. 154(b) by 0 days.

(21) Appl. No.: 14/227,711

(22) Filed: Mar. 27, 2014

(51) Int. Cl.

| | |
|---|---|
| ***B65F 1/16*** | (2006.01) |
| ***B65D 51/28*** | (2006.01) |
| ***B65D 25/28*** | (2006.01) |
| *B65F 1/14* | (2006.01) |

(52) U.S. Cl.
CPC ..... *B65D 51/28* (2013.01); *B65D 25/2802* (2013.01); *B65F 1/16* (2013.01); *B65F 1/1607* (2013.01); *B65F 2210/184* (2013.01)

(58) Field of Classification Search
CPC ..... B65F 1/004; B65F 1/0033; B65F 1/16; B65F 1/1607; B65F 2210/184; B65D 25/28; B65D 25/2802; B65D 51/2807; B65D 51/28
USPC ..... 220/212.5, 759, 768, 770, 766, 908, 220/909, 212
See application file for complete search history.

(56) References Cited

U.S. PATENT DOCUMENTS

| | | | | | |
|---|---|---|---|---|---|
| 659,150 | A * | 10/1900 | King | 220/522 |
| 1,892,988 | A * | 1/1933 | Knapp | 215/227 |
| 4,872,582 | A * | 10/1989 | Sipple | 220/603 |
| 5,042,676 | A * | 8/1991 | Gohlke | 220/759 |
| 5,603,404 | A * | 2/1997 | Nazare et al. | 206/366 |
| 2011/0168729 | A1 * | 7/2011 | Koenig et al. | 220/761 |

* cited by examiner

*Primary Examiner* — Stephen Castellano
(74) *Attorney, Agent, or Firm* — Kyle A. Fletcher, Esq.

(57) ABSTRACT

The recycling receptacle assembly includes a bin containing recyclable materials. A lid is positionable on the bin. A reservoir is coupled to the lid. The reservoir insertably receives a material. The material imparts a weight to the lid. A handle is operationally coupled to the reservoir.

17 Claims, 4 Drawing Sheets

RECYCLABLE STORAGE LID AND CONTAINER

CROSS REFERENCES TO RELATED APPLICATIONS

This application claims priority to the non-provisional patent application Ser. No. 13/590,412, which was filed on Aug. 21, 2012.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of recycling bins, more specifically, a recycling bin lid that protects the contents of a recycling bin.

SUMMARY OF THE INVENTION

An embodiment of the disclosure meets the needs presented above by generally comprising a bin containing recyclable materials. A lid is positionable on the bin. A reservoir is coupled to the lid. The reservoir insertably receives a material. The material imparts a weight to the lid. A handle is operationally coupled to the reservoir.

It is an object of the invention to provide a storage lid that is uniquely designed to secure atop of a recyclable container, and which protects the contents of said recyclable elements.

A further object of the invention is to provide a storage lid that includes a fillable chamber that can be filled with a material or sand that adds weight to the storage lid when placed atop of the recyclable container.

An even further object of the invention is to provide a handle that adorns an outer surface of the storage lid in order to provide a means for manipulating the storage lid atop of the recyclable container.

Another object of the invention is to provide a lip that extends along the bottom periphery of the storage lid in order to secure the storage lid onto the upper and outer periphery of the recyclable container.

These together with additional objects, features and advantages of the improved recyclable storage lid and container will be readily apparent to those of ordinary skill in the art upon reading the following detailed description of presently preferred, but nonetheless illustrative, embodiments of the improved recyclable storage lid and container when taken in conjunction with the accompanying drawings.

In this respect, before explaining the current embodiments of the improved recyclable storage lid and container in detail, it is to be understood that the improved recyclable storage lid and container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the improved recyclable storage lid and container.

It is therefore important that the claims be regarded as including such equivalent construction insofar as they do not depart from the spirit and scope of the improved recyclable storage lid and container. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
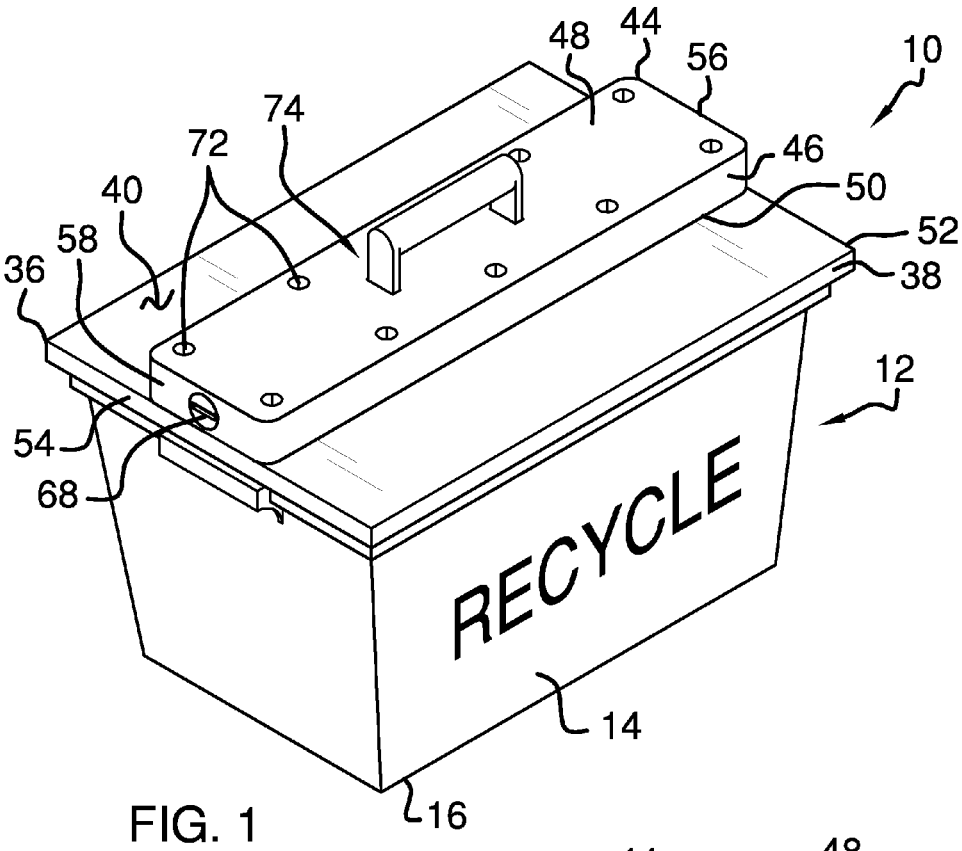
FIG. 1 is a perspective view of a recycling receptacle assembly according to an embodiment of the disclosure.
Figure 2:
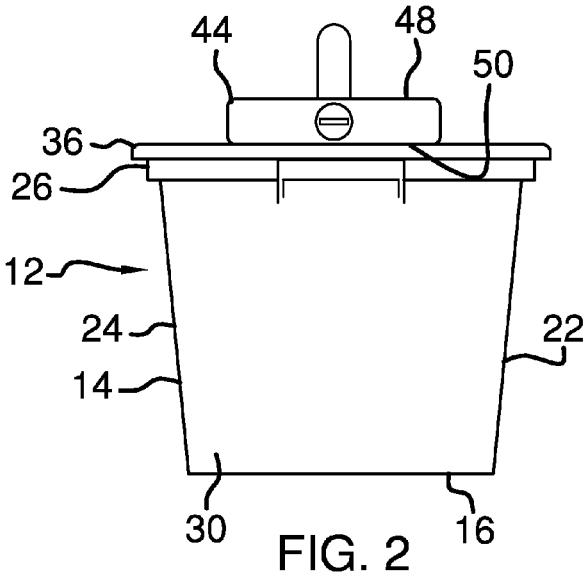
FIG. 2 is a right side view of an embodiment of the disclosure.
Figure 3:
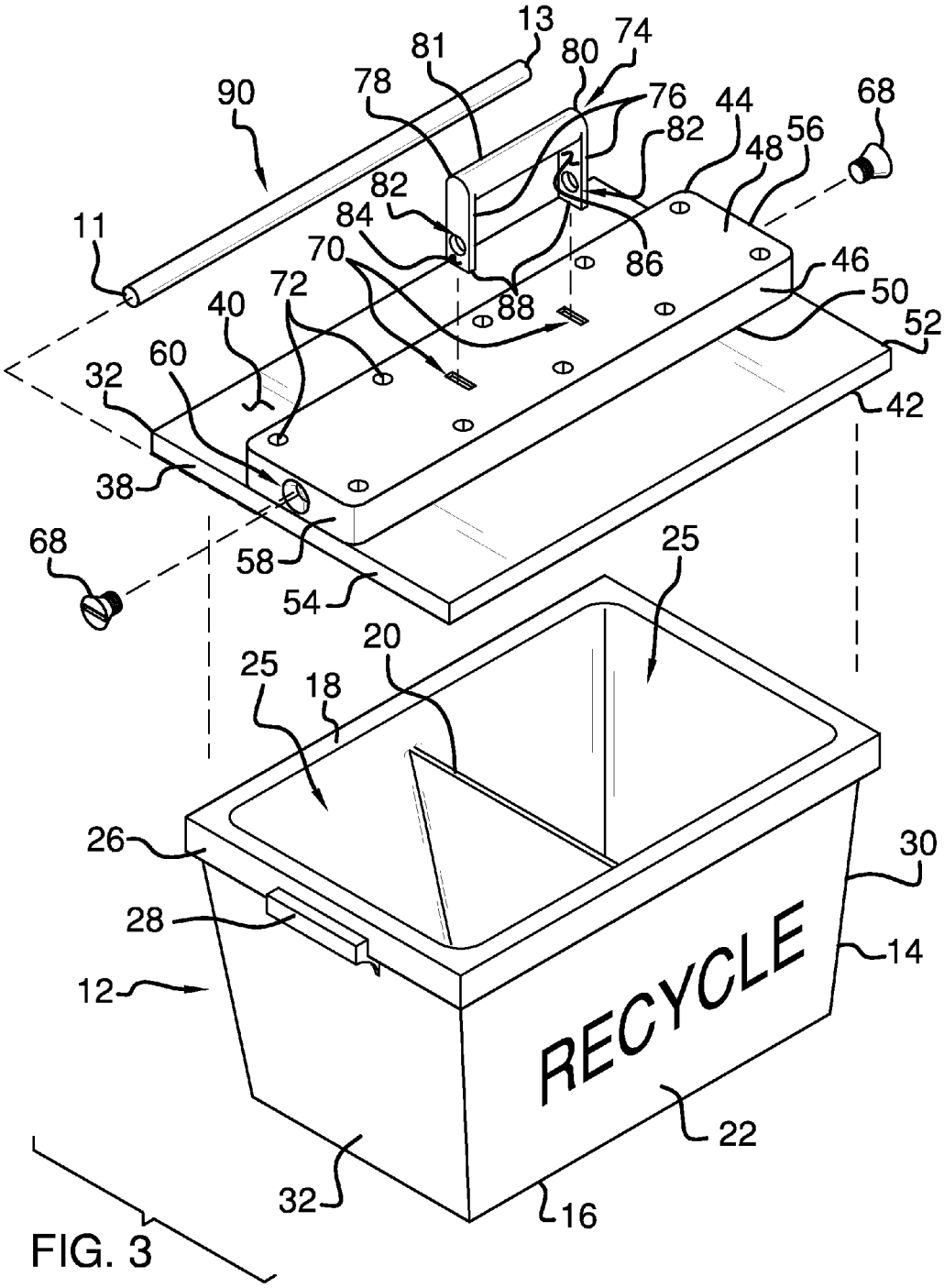
FIG. 3 is an exploded perspective view of an embodiment of the disclosure.
Figure 4:
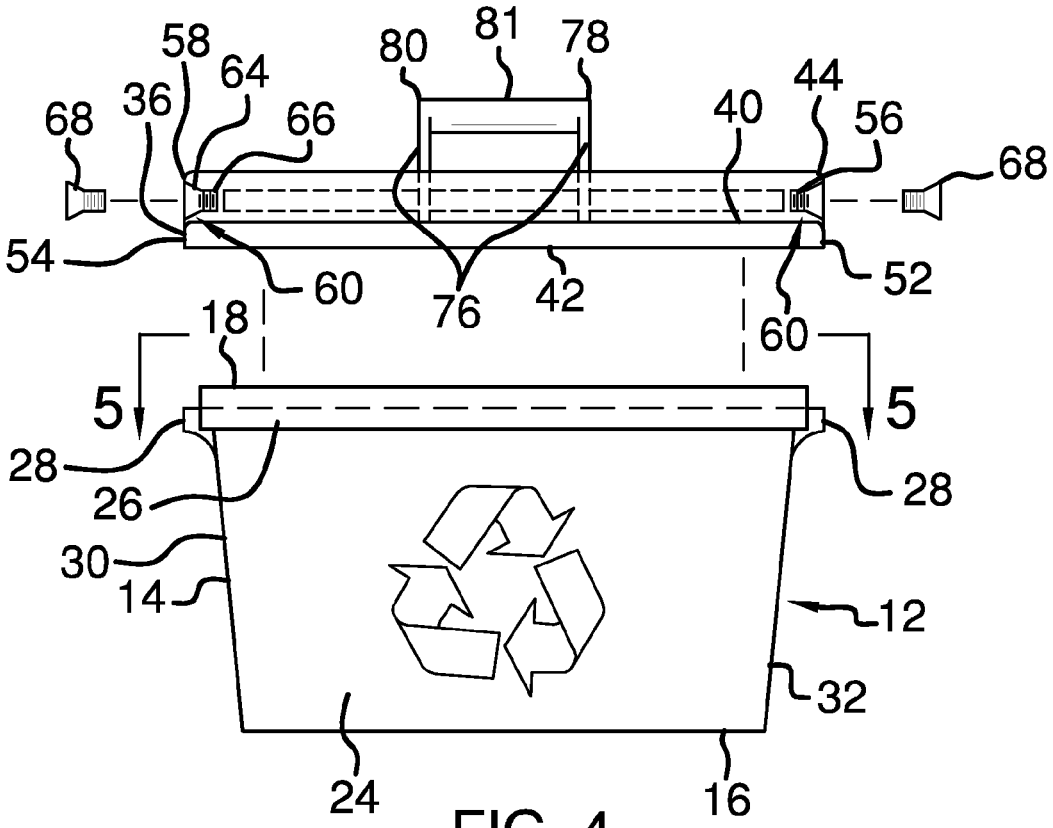
FIG. 4 is a back view of an embodiment of the disclosure.
Figure 5:
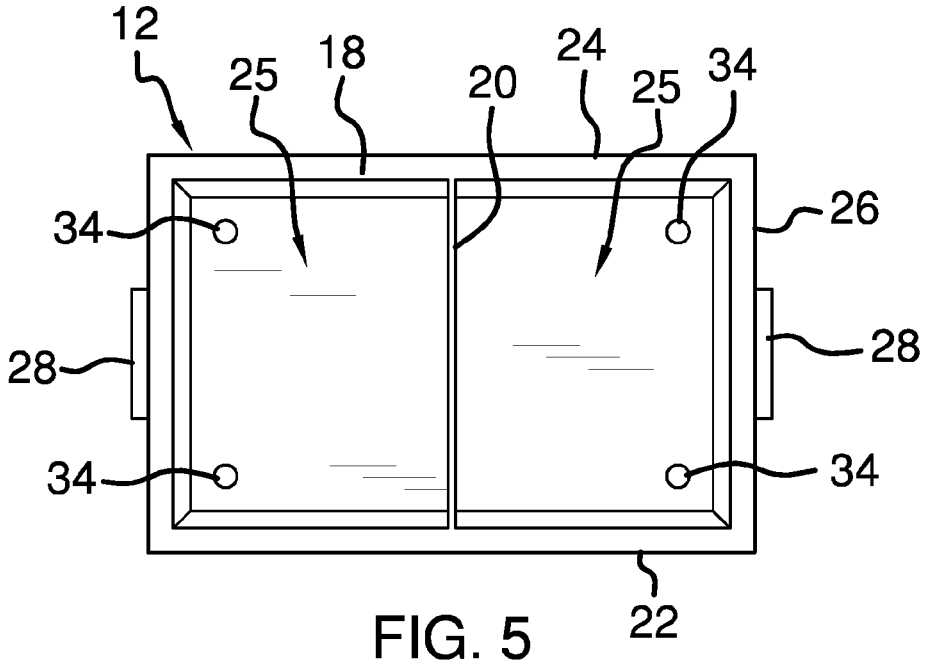
FIG. 5 is a top view of an embodiment of the disclosure.
Figure 6:
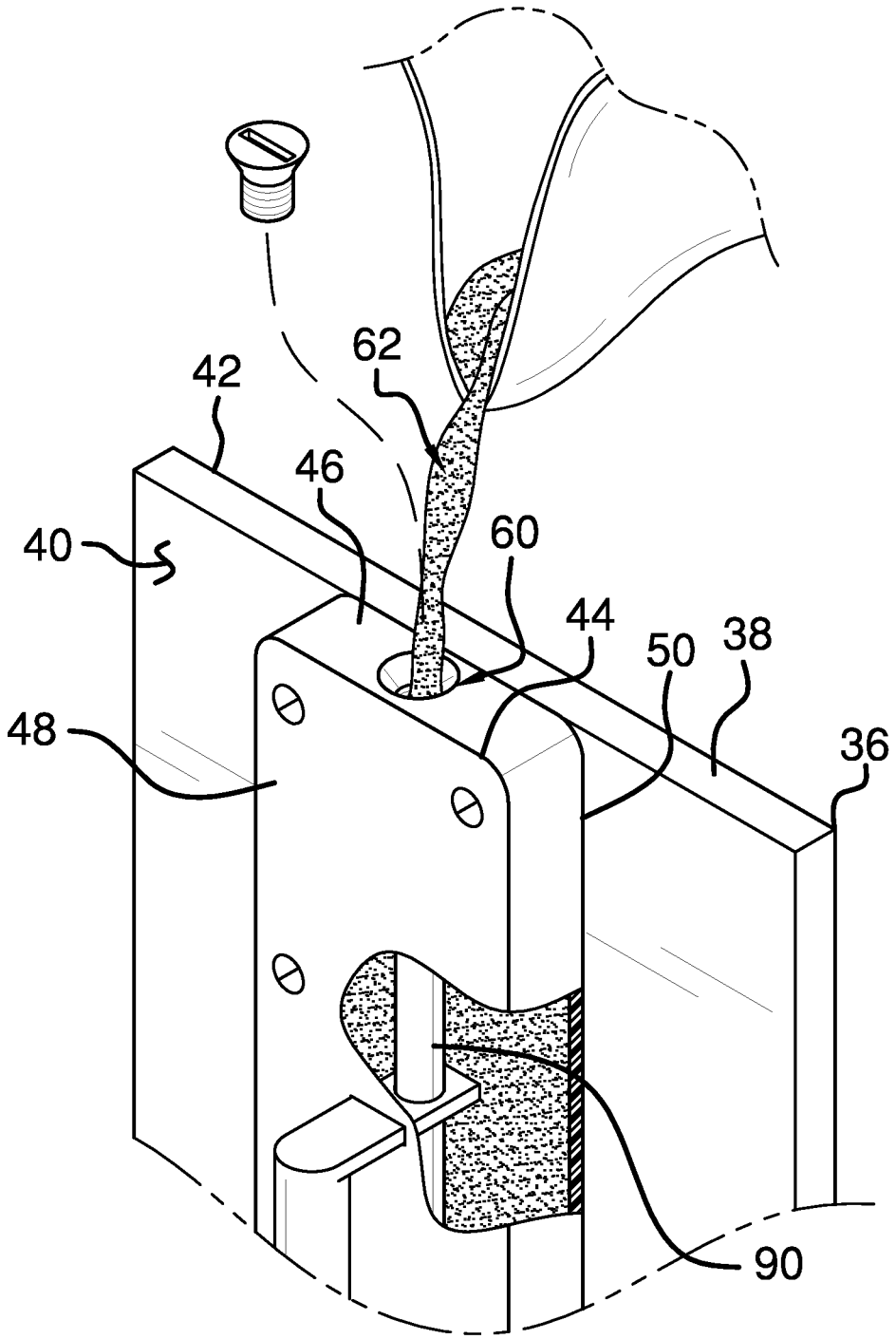
FIG. 6 is an in-use view of an embodiment of the disclosure.

As best illustrated in FIGS. 1 through 6, the recycling receptacle assembly 10 generally comprises a bin 12. An exterior wall 14 of the bin 12 extends upwardly from a bottom wall 16 of the bin 12. An upper edge 18 of the exterior wall 14 of the bin 12 defines an opening into an interior of the bin 12. The exterior wall 14 of the bin 12 flares outwardly from the bottom wall 16 of the bin 12.

The bin 12 has a trapezoidal shape. Additionally, the bin 12 contains recyclable materials. The recyclable materials may comprised empty cans and bottles. A dividing wall 20 is positioned within the interior of the bin 12. The dividing wall 20 extends between a front side 22 and a rear side 24 of the exterior wall 14 of the bin 12. The dividing wall 20 defines a pair of containment areas 25 within the interior of the bin 12.

A lip 26 extends outwardly from the exterior wall 14 of the bin 12. The lip 26 is coextensive with the upper edge 18 of the exterior wall 14 of the bin 12. A pair of grips 28 is coupled to an associated one of a first flanking side 30 and a second flanking side 32 of the exterior wall 14 of the bin 12. Each of the pair of grips 28 is positioned proximate the upper edge 18 of the exterior wall 14 of the bin 12. The pair of grips 28 may be gripped so the bin 12 may be carried.

The bottom wall 16 of the bin 12 has a plurality of drain apertures 34 extending therethrough. Each of the plurality of drain apertures 34 is positioned proximate an associated one of four corners of the bottom wall 16 of the bin 12.

A lid 36 is provided. An outer edge 38 of the lid 36 extends between a top surface 40 and a bottom surface 42 of the lid 36. The lid 36 is positionable on the upper edge 18 of the exterior wall 18 of the bin 14. Moreover, the lid 36 closes the bin 12.

A reservoir 44 has an exterior wall 46 extending between a top wall 48 and a bottom wall 50 of the reservoir 44. The reservoir 44 has a length that is greater than a width of the reservoir 44. Additionally, the reservoir 44 has a rectangular parallelepiped shape. The reservoir 44 is substantially hollow.

The bottom wall 50 of the reservoir 44 is coupled to the top surface 40 of the lid 36. The reservoir 44 extends between a first lateral side 52 and a second lateral side 54 of the outer edge 38 of the lid 36. Each of a first oblique side 56 and a second oblique side 58 of the exterior wall 46 of the reservoir 44 has an associated one of a pair of fill apertures 60 extending therethrough. A material 62 is poured through a selected one of the pair of fill apertures 60 so the material 62 imparts a weight to the lid 36. The material 62 may be a fluid such as water or a solid such as sand.

A front end 64 of each of the pair of fill apertures 60 has a diameter that is greater than a diameter of a rear end 66 of each of the pair of fill apertures 60. A pair of plugs 68 is provided. Each of the pair of plugs 68 threadably engages an associated one of the pair of fill apertures 60. Each of the pair of plugs 68 closes the associated pair of fill apertures 60.

The top wall 48 of the reservoir 44 has a pair of handle slots 70 extending therethrough. The pair of handle slots 70 is laterally spaced apart from a center of the reservoir 44. Additionally, the pair of handle slots 70 is oriented parallel to each of the first 56 and second 58 oblique sides of the exterior wall 46 of the reservoir 44.

A plurality of fasteners 72 extends downwardly through the top wall 48 of the reservoir 44. The plurality of fasteners 72 engages the top surface 40 of the lid 36. Additionally, the plurality of fasteners 72 are evenly spaced apart and distributed around an entire perimeter of the exterior wall 46 of the reservoir 44. The plurality of fasteners 72 may be screws of any conventional design.

A handle 74 is provided. A pair of longitudinal arms 76 of the handle 74 extend downwardly from an associated one of a first end 78 and a second end 80 of a lateral arm 81 of the handle 74. The handle 74 has a U-shape. A pair of rod apertures 82 extends through an outer surface 84 and an inner surface 86 of an associated one of the pair of longitudinal arms 76 of the handle 74. The pair of rod apertures 82 are positioned proximate a free end 88 of each of the longitudinal arms 76 of the handle 74. The free end 88 of each of the pairs of longitudinal arms 76 of the handle 74 are insertable into an associated one of the pair of handle slots 70 in the reservoir 44.

A rod 90 is provided. The rod 90 has a primary end 11 and a secondary end 13. Moreover, the rod 90 is elongated. The rod 90 is insertable into a selected one of the pair of fill apertures 60 in the reservoir 44. The rod 90 is inserted into the reservoir 44 after the handle 74 is inserted into the pair of handle slots 70 in the reservoir 44. Moreover, the rod 90 extends through each of the pair of rod apertures 82 in the handle 74 so the handle 74 is retained on the reservoir 44.

In use, a selected one of the pair of plugs 68 is removed from the associated pair of fill apertures 60. The material 62 is poured into the reservoir 44. The rod 90 and the handle 74 are each removed from the reservoir 44. Removing the handle 74 from the reservoir 44 ensures an animal cannot grip the handle 74 and gain access to the recyclable material in the bin 12. The handle 74 and the rod 90 are re-coupled to the reservoir 44 when the lid 36 is to be carried.

With respect to the above description, it is to be realized that the optimum dimensional relationship for the various components of the recycling receptacle assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the recycling receptacle assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A recycling receptacle assembly having a weighted lid such that the lid cannot be removed by an animal, said assembly comprising:

a bin containing recyclable materials;

a lid positionable on said bin;

a reservoir coupled to said lid, said reservoir insertably receiving a material such that the material imparts a weight to the lid;

a handle operationally coupled to said reservoir;

each of a first oblique side and a second oblique side of an exterior wall of said reservoir having an associated one of a pair of fill apertures extending there through;

the material being poured through a selected one of said pair of fill apertures;

a top wall of said reservoir having a pair of handle slots extending there through;

said pair of handle slots being laterally spaced apart from a center of said reservoir;

said pair of handle slots being oriented parallel to each of a first oblique side and a second oblique side of an exterior wall of said reservoir.

2. The assembly according to claim 1, wherein said bin having an exterior wall of said bin extending upwardly from a bottom wall of said bin.

3. The assembly according to claim 2 wherein an upper edge of said exterior wall of said bin defining an opening into an interior of said bin.

4. The assembly according to claim 3, wherein said exterior wall of said bin flaring outwardly from said bottom wall of said bin such that said bin has a trapezoidal shape.

5. The assembly according to claim 1, wherein:

said lid having an outer edge extending between a top surface and a bottom surface of said lid; and said lid being positionable on an upper edge of an outer wall of said bin such that said lid closes said bin.

6. The assembly according to claim 1, wherein:

said reservoir having an exterior wall extending between a top wall and a bottom wall of said reservoir; and said reservoir having a length being greater than a width of said reservoir such that said reservoir has a rectangular parallelepiped shape.

7. The assembly according to claim 1, wherein said reservoir being substantially hollow.

8. The assembly according to claim 1, wherein a bottom wall of said reservoir being coupled to a top surface of said lid such that said reservoir extends between a first lateral side and a second lateral side of an outer edge of said lid.

9. The assembly according to claim 1, wherein said handle having a pair of longitudinal arms extending downwardly from an associated one of a first end and a second end of a lateral arm of said handle such that said handle has a U-shape.

10. The assembly according to claim 1, wherein each of a pair of longitudinal arms of said handle having an associated one of a pair of rod apertures extending through an outer surface and an inner surface of said pair of longitudinal arms of said handle proximate a free end of each of said longitudinal arms of said handle; and said free end of each of said pairs of longitudinal arms of said handle being insertable into an associated one of a pair of slots in said reservoir.

11. The assembly according to claim 1, wherein a rod having a primary end and a secondary end, said rod being elongated.

12. The assembly according to claim 11, wherein said rod being insertable into a selected one of a pair of fill apertures in said reservoir after said handle is inserted into a pair of slots in said reservoir.

13. The assembly according to claim 11, wherein said rod extending through each of a pair of rod apertures in said handle such that said handle is retained on said reservoir.

14. A recycling receptacle assembly having a weighted lid such that the lid cannot be removed by an animal, said assembly comprising:

a bin having an exterior wall of said bin extending upwardly from a bottom wall of said bin, said bin containing recyclable materials;

a lid positionable on said bin;

a reservoir coupled to said lid, said reservoir insertably receiving a material such that the material imparts a weight to the lid;

a handle operationally coupled to said reservoir;

wherein each of a first oblique side and a second oblique side of an exterior wall of said reservoir having an associated one of a pair of fill apertures extending there through; the material being poured through a selected one of said pair of fill apertures; a top wall of said reservoir having a pair of handle slots extending there through; said pair of handle slots being laterally spaced apart from a center of said reservoir; said pair of handle slots being oriented parallel to each of said first and second oblique sides of said exterior wall of said reservoir.

15. The assembly according to claim 14, wherein an upper edge of said exterior wall of said bin defining an opening into an interior of said bin; said exterior wall of said bin flaring outwardly from said bottom wall of said bin such that said bin has a trapezoidal shape; said lid having an outer edge extending between a top surface and a bottom surface of said lid; said lid being positionable on said upper edge of said outer wall of said bin such that said lid closes said bin.

16. The assembly according to claim 14 wherein said reservoir having an exterior wall extending between a top wall and a bottom wall of said reservoir; said reservoir having a length being greater than a width of said reservoir such that said reservoir has a rectangular parallelepiped shape; said reservoir being substantially hollow; said bottom wall of said reservoir being coupled to a top surface of said lid such that said reservoir extends between a first lateral side and a second lateral side of an outer edge of said lid.

17. The assembly according to claim 14, wherein said handle having a pair of longitudinal arms extending downwardly from an associated one of a first end and a second end of a lateral arm of said handle such that said handle has a U-shape; each of said pair of longitudinal arms of said handle having an associated one of a pair of rod apertures extending through an outer surface and an inner surface of said pair of longitudinal arms of said handle proximate a free end of each of said longitudinal arms of said handle; said free end of each of said pairs of longitudinal arms of said handle being insertable into an associated one of a pair of slots in said reservoir; a rod having a primary end and a secondary end, said rod being elongated; said rod being insertable into a selected one of a pair of fill apertures in said reservoir after said handle is inserted into a pair of slots in said reservoir; said rod extending through each of a pair of rod apertures in said handle such that said handle is retained on said reservoir.

* * * * *